United States Patent [19]

Greenway et al.

[11] 4,138,840

[45] Feb. 13, 1979

[54] HEAT TRANSFER

[75] Inventors: John M. Greenway; Frederick W. Shaw, both of Harrogate, England

[73] Assignee: Imperial Chemical Industries Limited, Great Britain

[21] Appl. No.: 766,313

[22] Filed: Feb. 7, 1977

Related U.S. Application Data

[63] Continuation of Ser. No. 623,884, Oct. 20, 1975, abandoned.

[30] Foreign Application Priority Data

Oct. 18, 1974 [GB] United Kingdom ..... 45206/74
Nov. 6, 1974 [GB] United Kingdom ..... 47974/74

[51] Int. Cl.[2] ..... D01H 13/28; D02G 1/02
[52] U.S. Cl. ..... 57/289; 57/34 HS
[58] Field of Search ..... 57/34 R, 34 B, 34 HS, 57/157 R, 157 TS, 157 MS, 77.3; 34/155

[56] References Cited

U.S. PATENT DOCUMENTS

| | | | |
|---|---|---|---|
| 2,398,856 | 4/1946 | Reel | 34/155 X |
| 3,279,164 | 10/1966 | Breen et al. | 57/34 B X |
| 3,486,318 | 12/1969 | Cannon et al. | 57/34 B |
| 3,551,549 | 12/1970 | Sunbbeck | 34/155 X |
| 3,686,845 | 8/1972 | Okada et al. | 57/34 HS |
| 3,706,192 | 12/1972 | Leibbrand et al. | 57/34 B X |
| 3,720,079 | 3/1973 | Katsumata et al. | 57/34 HS X |
| 3,796,036 | 3/1974 | Parker | 57/34 HS X |
| 3,848,404 | 11/1974 | London | 57/34 HS |
| 3,921,419 | 11/1975 | Rosenkranz et al. | 34/155 X |
| 3,958,407 | 5/1976 | Roden | 57/34 HS X |

FOREIGN PATENT DOCUMENTS

| | | | |
|---|---|---|---|
| 830183 | 1/1952 | Fed. Rep. of Germany | 57/77.3 |
| 773816 | 5/1957 | United Kingdom | 57/34 HS |
| 1275851 | 5/1972 | United Kingdom. | |

*Primary Examiner*—Donald Watkins
*Attorney, Agent, or Firm*—Robert J. Blanke

[57] ABSTRACT

Process and apparatus for transferring heat between an advancing filamentary yarn and a fluid in which the yarn is passed through a vortex in the fluid substantially along or parallel to the longitudinal axis of the vortex.

4 Claims, 8 Drawing Figures

HEAT TRANSFER

This is a continuation of application Ser. No. 623,884, now abandoned filed Oct. 20, 1975.

The present invention relates to heat exchangers and in particular to a process and apparatus for transferring heat between an advancing filamentary yarn which may be twisting, as for example in a false twist crimping (texturing) process, and a fluid.

According to the invention there is provided a process for transferring heat between an advancing filamentary yarn and a fluid in which the yarn is passed through a vortex in the fluid substantially along or parallel to the longitudinal axis of the vortex.

The invention also provides an apparatus for transferring heat between an advancing filamentary yarn and a fluid comprising yarn advancing means and fluid vortex inducing means arranged so that the yarn may advance substantially along or parallel to the longitudinal axis of the vortex. Thus, heat may be transferred to and/or from an advancing filamentary yarn by the process and apparatus of the invention.

Preferably, the yarn after passing through one or more fluid vortices is advanced to false twisting means.

Advantageously, two fluid vortices may be employed in a yarn false twist texturing process so that the yarn may be successively heated and cooled before it reaches the false twisting means.

In the apparatus of the present invention the fluid vortex inducing means preferably comprises a chamber having tangential fluid entry channels arranged symmetrically around the chamber circumference. Additionally yarn entry and exit tubes are also arranged one on either side of the chamber so as to contain the vortex induced in the chamber. These tubes are long in comparison with the size of the chamber so that the vortex may be maintained in contact with an advancing yarn for a relatively long period.

In neither the processes nor apparatus of the present invention do the fluid vortices cause significant filament interlacing or false twist in the yarn which is passed therethrough. In this respect the processes and apparatus of the invention differ markedly from similar processes and apparatus which are known to induce considerable yarn interlacing and false twist.

Apparatus suitable for carrying out a process according to the present invention is shown in the accompanying figures in which.

Figure 1A:
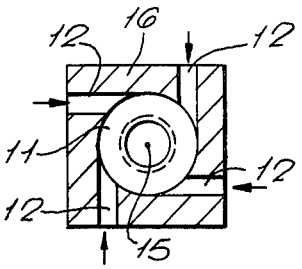
FIG. 1A shows a horizontal section through the centre of a fluid vortex generator.

Referring to these figures the vortex generator comprises a tapered central chamber 11 of circular cross section located in a metal block 16 with four tangential fluid entry channels or jets 12 arranged symmetrically around the circumference of the chamber. Yarn entry and exit tubes 13 and 14 respectively, which may be identical (as shown) or different in diameter and/or length, are located one on each side of the vortex chamber and serve to contain the fluid vortex which is generated in the chamber. Fluid, e.g. air, is supplied to the tangential jets as indicated in the drawings via a passageway 17 in a surrounding concentric metal block 18. High temperature resistant compressible seal rings 19 provide a fluid tight joint between the metal blocks 16 and 18.

Any fluid, gaseous or liquid, which is substantially inert to the yarn may be used but preferably the fluid is gaseous at the temperature of the process. In addition to air mentioned above, carbon dioxide, nitrogen or steam may also be employed.

One or more chambers may be employed in the vortex generator with any number of fluid entry channels or jets. Also, the entry channels or jets need not be tangentially arranged and may also be in staggered relationship so long as an effective fluid vortex can be produced.

The yarn entry and exit tubes may or may not have the same diameter as that of the vortex chamber and may also be of variable diameter.

In operation, a fluid such as air, which may be at ambient temperature or be cooled or heated by external means (not shown) is supplied to the four tangential jets of the vortex generator (as shown) while yarn 15 enters and leaves the chamber through tubes 13 and 14 respectively. The air vortex generated in the chamber passes into and is contained by the tubes 13 and 14 so that the yarn advances substantially along or parallel to the longitudinal axis of the vortex. The vortex slowly decays as it moves along the tubes and away from the chamber, finally escaping into the surrounding atmosphere.

Figure 1B:
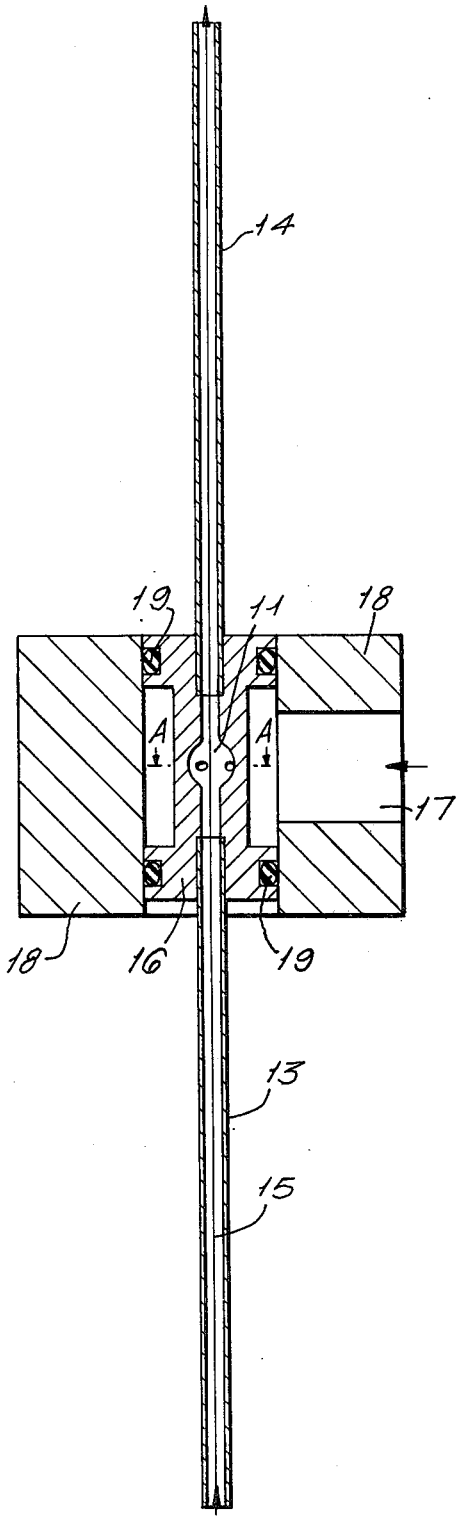
FIG. 1B shows a vertical section through the same vortex generator when fitted with yarn entry and exit tubes.
Figure 2A:
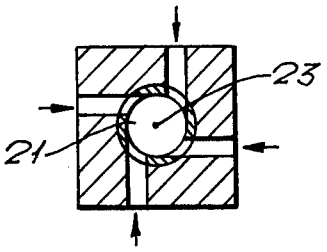
FIG. 2A shows a horizontal section through the center of a fluid vortex generator.
Figure 2B:
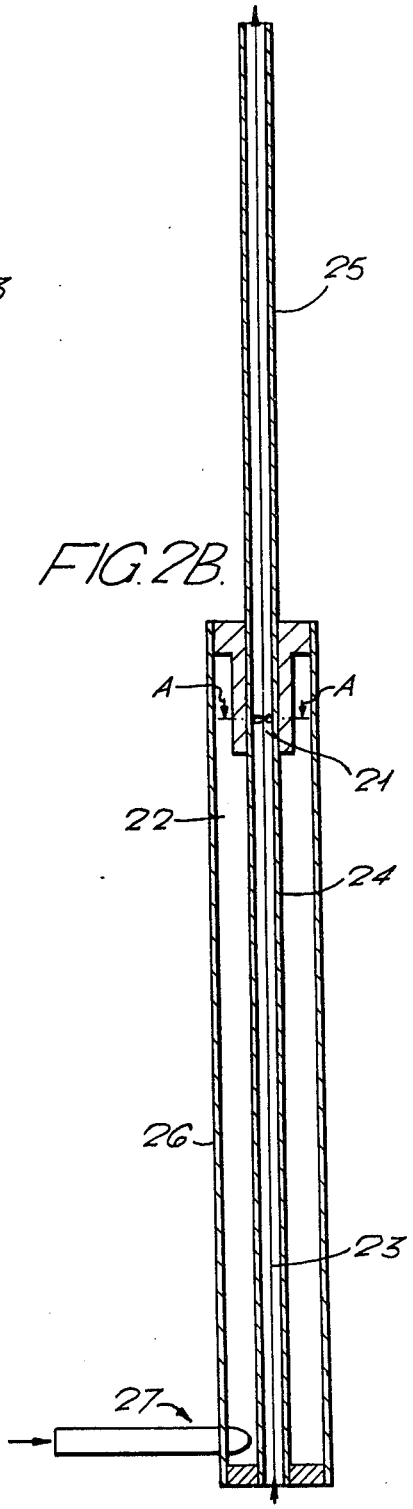
FIG. 2B shows a vertical section through the same vortex generator when fitted with yarn entry and exit tubes.
Figure 2C:
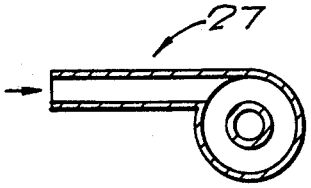
FIG. 2C shows a horizontal section of the fluid inlet means of the fluid vortex generator of FIG. 2B.

A modification of the device shown in FIGS. 1A and 1B is shown in FIGS. 2A and 2B. In this arrangement fluid is supplied to the vortex generating "chamber" 21 via an outer chamber 22 where the fluid acts to preheat or precool the advancing yarn 23, as the case may be. Unlike the device described above the vortex "chamber" is part of a continuous tube of uniform diameter which also serves as the yarn entry and exit tube (parts 24 and 25 respectively). Advantageously the gap between the wall 26 of the chamber 22 and the yarn tube 24 is small and the fluid is fed tangentially as indicated (by means 27 which is shown in cross-section in FIG. 2C) so that a vortex is generated with a long path length for good preheating/precooling. When precooling is required the outer chamber 22 may be surrounded by a water jacket.

In all of the subsequent examples the polyester yarn used was derived from polyethylene terephthalate.

The various measurements reported in the examples were taken by conventional means well known to those skilled in the art, unless otherwise indicated. All of the following examples are intended only to illustrate the present invention.

EXAMPLE 1

In this example two identical heat transfer devices similar to those shown in FIGS. 2A and 2B were used. The vortex "chamber" had a maximum internal diameter of 2.54 mm and the four air entry jets a diameter of 0.51 mm. The continuous yarn entry and exit tube had an overall length of about 305 mm.

The two devices were employed respectively as a yarn heater and a yarn cooler in a simultaneous drawing and false twist crimping (texturing) process, in which a partially oriented or drawn 355 decitex 30 filament polyester yarn (birefringence $26 \times 10^{-3}$) was advanced by feed rolls, first through the heating device and then through the cooling device to a friction twisting bush (single pass and similarly in all subsequent examples) and then to draw rolls. The draw roll speed was 600 meters/minute and the twisting bush was rotated at 19,500 r.p.m. The draw ratio was 2.1. Operating conditions and yarn temperatures were as follows:

| | |
|---|---|
| Heater | Air temperature 250° C.<br>Air pressure 80 p.s.i. |
| *Yarn temperature | Entry 20° C.(ambient)<br>Exit 200° C. |
| Cooler | Air temperature 20° C.(ambient)<br>Air pressure 90 p.s.i. |
| *Yarn temperature | Entry 165° C.<br>Exit 80° C. |

*Using an infra-red scanning pyrometer available from Cambridge Consultants Ltd., Cambridge, England.

It was observed that the fluid vortices did not cause significant filament interlacing or false twist in the yarn.

Figure 3A:
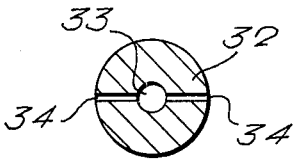
FIG. 3A shows a horizontal section through the center of a fluid vortex generator.
Figure 3B:
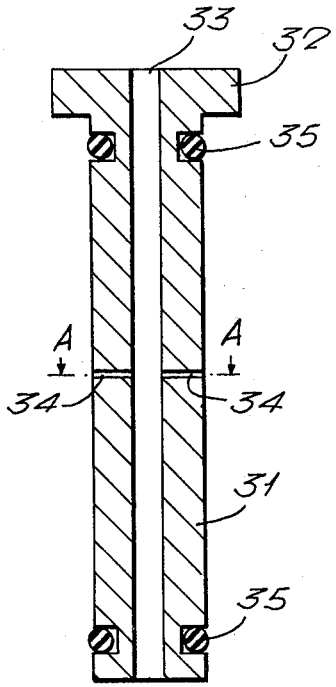
FIG. 3B shows a vertical section of the same vortex generator.
Figure 4:
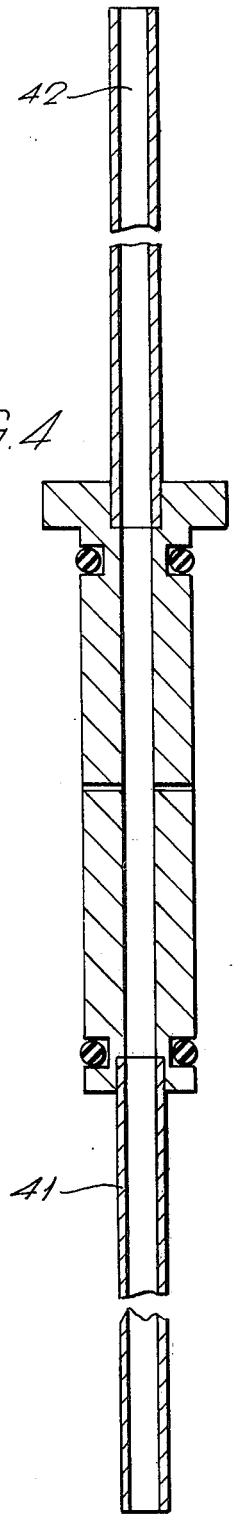
FIG. 4 is a vertical section of the same vortex generator of FIG. 3B fitted with yarn entry and exit tubes.

For comparative purposes where applicable since it has been suggested that high heat transfer can be achieved with such devices, a known air jet interlacer device is also exemplified and is shown in horizontal and vertical sections in FIGS. 3A and 3B respectively. FIG. 4, also in vertical section, shows a modified version of the jet of FIG. 3 when fitted with yarn entry and exit tubes so as to correspond more closely with the devices of the present invention shown in FIGS. 1B and 2B.

Referring particularly to FIGS. 3A/B the jet comprises a hollow metal cylindrical block 31 of circular cross-section with a circular lip 32 at one end to assist in locating the jet in supporting apparatus. The axial bore 33 is also of circular cross-section (diameter 2.50 mm) and runs the whole length of the block 31 to provide a yarn passageway (55 mm). Located approximately equidistant from the ends of the block are two radially disposed directly opposed fluid entry channels or jets 34 (diameter 0.71 mm). These channels permit simultaneous fluid entry to the bore 33 from opposed opposite directions. High temperature resistant compressible seal rings 35 form a fluid tight joint between the cylindrical block and the fluid supply apparatus (not shown).

The modified jet shown in FIG. 4 is identical in all respects with that shown in FIGS. 3A and 3B and described above, with the exception that identical yarn entry and exit tubes 41 and 42 respectively are provided in order to contain any fluid vortex that may be created by the jet. The overall length of the device was 305 mm.

In all of the following examples a heat transfer device similar to that shown in FIGS. 2A and 2B was used except that no outer chamber 22 was provided; instead heated air was supplied directly to the vortex generating "chamber" 21. The vortex chamber had a circular internal diameter of 2.34 mm and the four tangentially arranged circular air entry jets a diameter of 0.76 mm. The overall length of the device was 305 mm.

EXAMPLES 2-6

These examples demonstrate the high heat transfer efficiency of the device of the present invention when compared with the air jet interlacer described above.

EXAMPLE 2

The heat transfer efficiency of the three devices described above:

(A) according to FIGS. 2A/B/C but modified as described (B) according to FIGS. 3A/B (C) according to FIG. 4 was investigated by separately employing each of the devices as twist setting means in a conventional simultaneous polyester draw texturing process. The process was similar to that described in Example 1 with the exception that a similar device was not used to cool the advancing yarn.

Operating conditions were as follows:

Supply yarn — 325 f 30 polyester yarn; birefringence $27 \times 10^{-3}$

Draw roll speed — 600 meters/minute

Bush speed — 18,500 r.p.m.

Draw ratio — 2.1

The results of the three experiments are tabulated below:

| Device A | Mean Air Temp in Chamber ° C. | Pressure psi | Airflow cfh | Mean Yarn Temp on exit from Device ° C. |
|---|---|---|---|---|
| | 278 | 10 | 50 | 167 |
| | 279 | 15 | 60 | 180 |
| | 280 | 20 | 68 | 187 |
| | 284 | 30 | 94 | 208 |
| | 284 | 30 | 94 | 206 |
| | 286 | 40 | 120 | 211 |
| | 286 | 40 | 120 | 208 |
| | 288 | 50 | 140 | 220 |
| | 289 | 60 | 168 | 225 |
| | 290 | 70 | 196 | 226 |

| Device B | Mean Air Temp in Chamber ° C. | Pressure psi | Airflow cfh | Mean yarn Temp on Exit from Device ° C. |
|---|---|---|---|---|
| | 286 | 40 | 55 | 115 |
| | 289 | 60 | 80 | 122 |
| | 289 | 60 | 80 | 124 |
| | 290 | 80 | 98 | 126 |
| | 291 | 100 | 120 | 126 |
| | 291 | 110 | 130 | 130 |
| | 292 | 120 | 140 | 128 |

| Device C | Mean Air Temp in Chamber ° C. | Pressure psi | Airflow cfh | Mean yarn Temp on Exit from Device ° C. |
|---|---|---|---|---|
| | 286 | 40 | 55 | 145 |
| | 289 | 60 | 80 | 156 |
| | 290 | 70 | 88 | 160 |
| | 290 | 80 | 98 | 163 |
| | 291 | 100 | 120 | 166 |

It is clear from these results that the device according to the present invention is a far more efficient heat exchanger than either Devices B or C when used under a variety of simultaneous yarn draw texturing processes.

EXAMPLE 3

In this example Device A was used as a twist setting means in a conventional sequential polyamide yarn drawn texturing process. Equally efficient heat transfer to that reported above was also found to occur. See table below. Operating conditions were as follows:

| Mean Air Temp in Chamber ° C. | Pressure psi | Airflow cfh | Mean Yarn Temp on Exit from Device ° C. |
|---|---|---|---|
| 284 | 30 | 94 | 188 |
| 286 | 40 | 120 | 205 |
| 289 | 60 | 168 | 215 |

EXAMPLE 4

This example was similar to Examples 2 and 3 above except that the texturing process used to demonstrate the efficiency of the present invention did not include yarn drawing. Thus the process exemplified resembles traditional yarn texturing where the supply yarn is fully drawn prior to texturing in a non-continuous process. Operating conditions were as follows:

Supply yarn — 167 f 30 polyester yarn; fully drawn

Processing speed (take-out roll speed) — 210 meters/minute

Bush speed — 6,000 r.p.m.

Similar distinguishing results (tabulated below) were found between the heat transfer efficiency of Devices A and C as were found in the previous examples.

| Device A | Mean Air Temp in Chamber ° C. | Pressure psi | Airflow cfh | Mean Yarn Temp on Exit from Device ° C. |
|---|---|---|---|---|
| | 279 | 15 | 55 | 220 |
| | 280 | 20 | 70 | 236 |
| | 284 | 30 | 94 | 250 |
| | 286 | 40 | 120 | 260 |

| Device C | Mean Air Temp in Chamber ° C. | Pressure psi | Airflow cfh | Mean Yarn Temp on Exit from Device ° C. |
|---|---|---|---|---|
| | 286 | 40 | 55 | 187 |
| | 289 | 60 | 80 | 200 |
| | 290 | 70 | 88 | 207 |
| | 290 | 80 | 98 | 214 |
| | 291 | 100 | 120 | 217 |

EXAMPLE 5

In this example as distinct from all the previous examples there was no yarn texturing. Instead untwisted (but for producer twist), fully drawn 167 f 30 polyester yarns were passed at 600 meters/minute through each of the Devices A, B and C under a variety of different air pressures and air flows and the relevant air and yarn temperatures measured. The results which clearly demonstrate the superior heat transfer efficiency of the device of the present invention are tabulated below:

| Device A | Mean Air Temp in Chamber ° C. | Pressure psi | Airflow cfh | Mean Yarn Temp on Exit from Device ° C. |
|---|---|---|---|---|
| | 279 | 15 | 60 | 178 |
| | 284 | 30 | 94 | 211 |
| | 286 | 40 | 120 | 223 |
| | 288 | 50 | 140 | 237 |
| | 289 | 60 | 168 | 247 |

| Device B | Mean Air Temp in Chamber ° C. | Pressure psi | Airflow cfh | Mean Yarn Temp on Exit from Device ° C. |
|---|---|---|---|---|
| | 290 | 80 | 98 | 135 |
| | 291 | 100 | 120 | 139 |
| | 292 | 115 | 128 | 142 |

| Device C | Mean Air Temp in Chamber ° C. | Pressure psi | Airflow cfh | Mean Yarn Temp on Exit from Device ° C. |
|---|---|---|---|---|
| | 286 | 40 | 55 | 143 |
| | 289 | 60 | 80 | 151 |

-continued

| | | | | |
|---|---|---|---|---|
| | 290 | 80 | 98 | 161 |
| | 291 | 100 | 120 | 158 |

EXAMPLE 6

This example is similar to Example 5 except that the polyester yarn (fully drawn 167 f 30) possesses a mean pretwist of 525 turns/meter and is processed at 200 meters/minute. Though no comparative results are given in respect of Devices B and C, it is clear that the use of Device A has resulted in a high rate of heat transfer from air to advancing yarn (of Example 5 results).

| Mean Air Temp in Chamber ° C | Pressure psi | Airflow cfh | Mean Yarn Temp on Exit from Device ° C. |
|---|---|---|---|
| 240 | 30 | 94 | 199 |
| 240 | 30 | 94 | 190 |
| 241 | 40 | 120 | 213 |
| 241 | 40 | 120 | 208 |
| 242 | 50 | 140 | 209 |
| 242 | 60 | 168 | 210 |
| 242 | 60 | 168 | 220 |

EXAMPLE 7

To distinguish the device of the present invention from the known Device B in terms of interlacing efficiency to which Device B is directed, fully drawn 167 f 30 polyester yarn containing producer-twist only was processed at 600 meters/minute under a variety of conditions using Devices A and B. The results are tabulated below. The degree of interlacing (coherency factor) was determined using the method described in U.K. patent specification No. 1,212,205.

| Device A | Air Pressure psi | Airflow cfh | Yarn Tension gms | Degree of Interlacing |
|---|---|---|---|---|
| | 20 | 68 | 10 | 82 |
| | " | " | 20 | 79 |
| | " | " | 30 | 84 |
| | 40 | 120 | 10 | 93 |
| | " | " | 20 | 87 |
| | " | " | 30 | 85 |
| | 60 | 168 | 10 | 114 |
| | " | " | 20 | 117 |
| | " | " | 30 | 101 |
| | 80 | 220 | 10 | 122 |
| | " | " | 20 | 109 |
| | " | " | 30 | 93 |
| | 100 | 270 | 10 | 101 |
| | " | " | 20 | 93 |
| | " | " | 30 | 112 |
| Degree of interlacing of supply yarn 80 | | | | |

| Device B | Air Pressure psi | Airflow cfh | Yarn Tension gms | Degree of Interlacing |
|---|---|---|---|---|
| | 40 | 55 | 5 | 130 |
| | " | " | 10 | 115 |
| | " | " | 20 | 122 |
| | " | " | 30 | 113 |
| | 60 | 80 | 5 | 140 |
| | " | " | 10 | 146 |
| | " | " | 20 | 126 |
| | " | " | 30 | 146 |
| | 80 | 98 | 5 | 122 |
| | " | " | 10 | 149 |
| | " | " | 20 | 160 |
| | " | " | 30 | 100 |
| | 100 | 120 | 5 | 142 |
| | " | " | 10 | 123 |
| | " | 41 | 20 | 121 |
| | " | " | 30 | 127 |
| Degree of interlacing of supply yarn 80 | | | | |

Device C was also tried under similar operating conditions but no meaningful differences from the results obtained using Device B were found.

It is significant that Device A does not begin to interlace until the airflow is around 170 cfh whereas Device B interlaces at 55 cfh, and even at 170 cfh the 'averaged' degree of interlacing is lower than the 'averaged' degree for Device B at 55 cfh.

If it is remembered that Device A has twice as many air entry channels or jets as Device B, then the level of interlacing per jet for Device A is less than half that for Device B indicating such a significant difference between the two devices that the device according to the present invention can be readily distinguished from both Devices B and C.

EXAMPLE 8

In this example the device of the present invention was distinguished from similar devices which are designed to insert false twist in yarn but where the device may be supplied with heated fluid.

Referring the Example 5 above, snatches of yarn were taken from a position immediately upstream of Device A and the amount of twist in the yarn determined. The results are tabulated below:

| Air Pressure psi | Airflow cfh | Yarn Tension gms | Yarn Twist* tpm |
|---|---|---|---|
| 15 | 60 | 42 | 27 |
| 30 | 94 | 42 | 30 |
| 40 | 120 | 42 | 26.5 |
| 50 | 140 | 42 | 20 |
| 60 | 168 | 40 | 0 |

*original (producer) twist in yarn 20–30 tpm

In the case of the first four runs (air pressures 15–50 psi), since the measured twist represents no more than the original twist in the yarn the device has clearly made no contribution to the overall yarn twist level. In the final run at 60 psi the device has effectively removed the original twist from the yarn which represents a twist contribution of the order of 20–30 tpm. Since the twist level required from a conventional false twisting device for practical purposes is about 2500 tpm of yarn there can be no doubt that the device according to the present invention does not meaningfully insert any false twist.

EXAMPLE 9

This example is similar to Example 8 except that like Example 6 the polyester yarn (fully drawn 167 f 30) has a mean pretwist of 525 turns/meter. The results of a series of runs at 200 meters/minute at different air pressures, flows and yarn tensions are shown below:

| Air Pressure psi | Air Flow cfh | Yarn Tension gms | Yarn Twist tpm | Twist Contribution by Device A tpm |
|---|---|---|---|---|
| 30 | 94 | 30 | 820 | 295 |
| 30 | 94 | 35 | 810 | 285 |
| 40 | 120 | 30 | 890 | 365 |
| 40 | 120 | 35 | 875 | 350 |
| 50 | 140 | 30 | 880 | 355 |
| 50 | 140 | 35 | 830 | 305 |
| 60 | 168 | 30 | 860 | 335 |
| 60 | 168 | 35 | 850 | 325 |

Although the twist contribution by Device A is considerably higher in this example than reported in Example 8, there is no doubt that the level falls well short of that required in commercial terms (approx 2500 tpm) and thus to all intents and purposes Device A does not function as a false twisting device.

The invention is applicable to the heating and/or cooling of twisting, twisted or untwisted filamentary yarns though the heating and/or cooling of twisting yarns as exemplified above is preferred.

Though the present invention has been exemplified with respect to filamentary polyester and polyamide yarns, the invention is equally applicable to a large variety of other filamentary yarns, for example, as may be derived from other synthetic materials, such as polyacrylics or polyolefins; regenerated material polymers such as cellulose acetate or viscose rayon, or inorganic materials such as glass.

What we claim is:

1. In a false twisting process for continuous filament yarn wherein substantially parallel filaments are fed into a false twisting device, the improvement comprising transferring heat between an advancing continuous filament yarn and a fluid prior to subjecting said yarn to a false twisting operation, said yarn being advanced in the direction of its longitudinal axis through two substantially non-twisting and non-interlacing fluid vortices generated by fluid streams tangentially and symmetrically arranged about the path of the advancing yarn, said vortices decaying freely in opposite co-axial directions from their point of generation to the point of escape into the atmosphere, whereby heat exchange is effected while maintaining the individual filaments of the yarn bundle in substantially parallel configuration, and then false twisting said yarn.

2. The process according to claim 1 in which heat is transferred to the advancing yarn.

3. The process according to claim 1 in which heat is transferred from the advancing yarn.

4. The process according to claim 1 in which the yarn passes through fluid vortices which successively transfer heat to and from the yarn before it reaches the false twisting means.

* * * * *